US007793730B2

(12) United States Patent
Edwards

(10) Patent No.: US 7,793,730 B2
(45) Date of Patent: Sep. 14, 2010

(54) LUBRICATOR SYSTEM

(75) Inventor: Jeffrey Charles Edwards, Aberdeen (GB)

(73) Assignee: Enovate Systems Limited, Aberdeen (GB)

( * ) Notice: Subject to any disclaimer, the term of this patent is extended or adjusted under 35 U.S.C. 154(b) by 132 days.

(21) Appl. No.: 11/912,154

(22) PCT Filed: Apr. 20, 2006

(86) PCT No.: PCT/GB2006/001441

§ 371 (c)(1),
(2), (4) Date: Apr. 25, 2008

(87) PCT Pub. No.: WO2006/111752

PCT Pub. Date: Oct. 26, 2006

(65) Prior Publication Data

US 2009/0038807 A1 Feb. 12, 2009

(30) Foreign Application Priority Data

Apr. 22, 2005 (GB) ..... 0508140.1

(51) Int. Cl.
*E21B 19/00* (2006.01)

(52) U.S. Cl. ..... 166/381; 166/85.1; 166/85.5

(58) Field of Classification Search ..... 166/377–379, 166/381, 385, 387, 75.11, 92.1, 85.1, 70, 166/85.5, 705
See application file for complete search history.

(56) References Cited

U.S. PATENT DOCUMENTS

| | | | | |
|---|---|---|---|---|
| 3,924,686 | A | 12/1975 | Arnold | |
| 4,103,739 | A * | 8/1978 | Hall | 166/105 |
| 4,489,780 | A | 12/1984 | Duhon | |
| 5,873,415 | A * | 2/1999 | Edwards | 166/344 |
| 6,056,055 | A * | 5/2000 | Falconer et al. | 166/297 |
| 6,755,244 | B1 * | 6/2004 | Koopmans | 166/70 |
| 7,096,952 | B2 * | 8/2006 | Harmon et al. | 166/301 |
| 2007/0267197 | A1 * | 11/2007 | Pallini et al. | 166/367 |

FOREIGN PATENT DOCUMENTS

| | | |
|---|---|---|
| GB | 2 335 214 A | 9/1999 |
| WO | WO 00/08298 A1 | 2/2000 |

* cited by examiner

*Primary Examiner*—Shane Bomar
*Assistant Examiner*—Kipp C Wallace
(74) *Attorney, Agent, or Firm*—Tarolli, Sundheim, Covell & Tummino LLP

(57) ABSTRACT

A lubricator system for receiving the intervention tool string includes a tubular body defining a tubular bore, and the tubular bore having a wall portion defining an aperture with a tool guide disposed in said aperture. A first sleeve surrounds the tubular body and is moveable between a first position where said aperture is covered by the first sleeve and a second position where said aperture is uncovered whereby access is provided to said tubular bore via said aperture. The system also includes a seal to allow the lubricator system to withstand operating pressures when the first sleeve is in the first position.

19 Claims, 2 Drawing Sheets

LUBRICATOR SYSTEM

FIELD OF THE INVENTION

The present invention relates to a lubricator system for receiving an intervention tool string.

BACKGROUND OF THE INVENTION

Lubricator systems are widely used in oil exploration to enable wireline intervention tools to be introduced into the well. The system includes a tubular lubricator section mounted above the blow out prevented (BOP) and surface tree, which can be isolated to allow the intervention string to be installed and then pressurized to well pressure to allow the tool string to be lowered through the BOP into the well.

Current well intervention equipment dictates that when a tool string is required to be inserted into the production bore, an operator is winched up the rig approximately 30 feet, to a platform, in order to disconnect the lubricator section. The lubricator section is then swung to one side, to provide access for the intervention tool string, and the tool is inserted. The procedure is reversed to reconnect the lubricator section to the production tube. The lubricator section is then filled with fluid and pressurized to test pressures to ensure that once the surface tree is opened, and the lubricator exposed to well pressures, it will not leak or rupture.

The procedure described above for inserting a new tool into a well, and subsequently pressure testing the lubricator system to ensure its integrity, is a time consuming, and hence expensive, operation. In addition, the necessity of winching an operator approximately 30 feet in order to disconnect/reconnect the lubricator section generates safety hazards.

SUMMARY OF THE INVENTION

It is an object of the present invention to avoid or mitigate one or more of the above disadvantages.

According to a first aspect of the present invention there is provided a lubricator system, the lubricator system including:

a tubular body defining a tubular bore, and the tubular bore having a wall portion defining an aperture, a tool guide disposed in said aperture, first sleeve means surrounding the tubular body and being moveable between a first position where said aperture is covered by the first sleeve means and a second position where said aperture is uncovered whereby access is provided to said tubular bore via said aperture, and seal means to allow the lubricator system to withstand operating pressures when the first sleeve is in the first position.

Preferably, the system includes locking means engageable with the first sleeve means, said locking means being moveable between a locking and unlocking position.

Preferably, when the at least one locking means is engaged with the first sleeve means, the at least one locking means is held in position by a second sleeve means, the second sleeve means surrounding the locking means, the second sleeve means being moveable between a first position, preventing the at least one locking means from disengaging from the first sleeve means, and a second position, allowing the at least one locking means to disengage from the first sleeve means. Alternatively, the at least one locking means is held in position by hydraulic or pneumatic pressure.

Preferably, the at least one locking means are pivotable latches. Alternatively, the at least one locking means is a screwed connection or an expandable or collapsible split lock ring.

Preferably, the tool guide is dimensioned to be accommodated within the aperture defined by the wall portion.

Preferably, the tool guide is manufactured as a single piece. Alternatively, the tool guide comprises a plurality of individual fingers.

Preferably, the tool guide is mounted on a pivot, the pivot being mounted on the wall portion of the tubular body, the tool guide being pivotable between a first position where the tool guide does not encroach into the tubular bore and a second position where, in use, a tool string being lowered down the tubular bore will engage with the tool guide and be guided out of the bore through the aperture.

Preferably, the tool guide pivots from the first position to the second position under its own weight. Alternatively, the tool guide moves from the first position to the second position under the action of an applied force. Optionally, the applied force may be controlled hydraulically or pneumatically Advantageously, when the aperture is covered by the first sleeve means, the first sleeve means is engaged with the tool guide and the tool guide does not encroach into the tubular bore, and when the aperture is not covered by the first sleeve means, the tool guide is not engaged with the first sleeve means and the tool guide moves to the second tool guide position.

Preferably, the first sleeve means is moved hydraulically between the first and second positions. Alternatively, the first sleeve means is moved under the action of either an electric motor or a pneumatic actuator.

Preferably, the second sleeve means is moved hydraulically between the first and second positions. Alternatively, the second sleeve means is moved under the action of an electric motor.

Preferably, the seal means are bi-directional resilient seals.

Preferably, the lubricator system includes integral test ports to pressure test the system.

According to a second aspect of the present invention there is provided a method of inserting or removing a tool into or out of a lubricator section of a lubricator system, the method including the steps of:

displacing a first sleeve means to reveal a tubular body, said tubular body defining a tubular bore for receiving an intervention tool string, said tubular body defining an aperture, displacing a tool guide in said aperture in said tubular body to allow access to said bore for inserting or removing a tool, inserting or removing a tool into or out of the tubular bore through the aperture, replacing said tool guide, and replacing said first sleeve means.

In a preferred embodiment the method further includes the initial step of:

displacing a second sleeve to allow an at least one locking means to disengage from the first sleeve.

Furthermore, in a preferred embodiment the method further includes, subsequent replacing the first sleeve means, the step of:

replacing the second sleeve thereby actuating the at least one locking means and engaging the at least one locking means with the first sleeve.

By virtue of the present invention access can be gained to a tubular lubricator system without the need for splitting the lubricator system or an operator being required to work at high level.

BRIEF DESCRIPTION OF THE DRAWINGS

Embodiments of the invention will now be described by way of example with reference to the accompanying drawings in which.

DESCRIPTION OF EXAMPLE EMBODIMENTS

Figure 1:
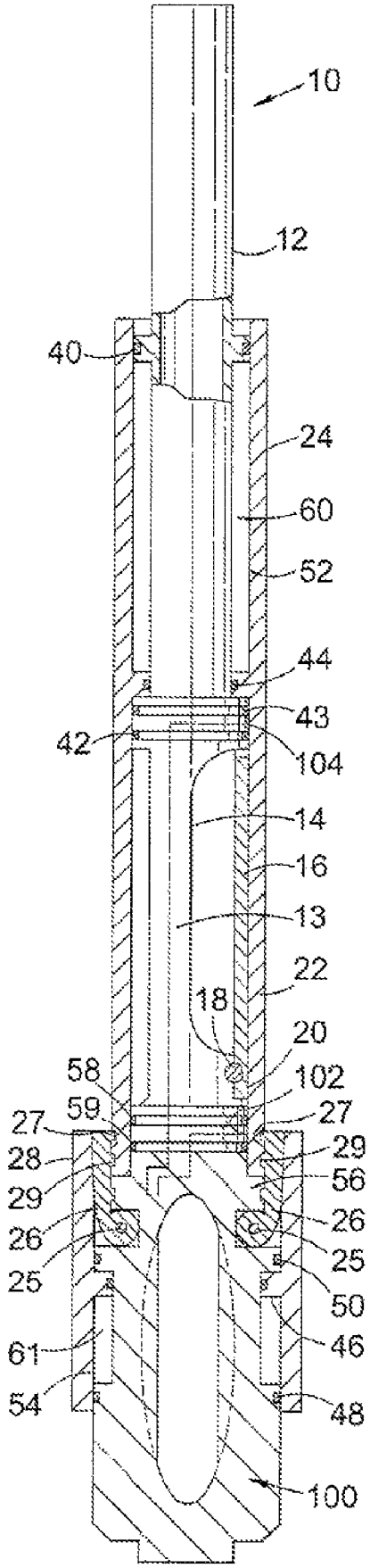
FIG. 1 is a partially cut away side view of part of a lubricator system, according to a first embodiment of the present invention.

Referring to FIG. 1, there is shown a partially cut away side view of part of a lubricator system, generally indicated by reference number 10, according to a first embodiment of the present invention. The lubricator system 10 is shown in its operational state, i.e. ready to be exposed to well pressures, and includes a tubular body 12, with a wall portion 13 defining an aperture 14 in a side wall of the tubular body 12, and a tool guide 16 mounted off-centre on the wall portion 13 using a pivot 18, the pivot 18 dividing the tool guide 16 into a lower portion 20 and an upper portion 22. The tool guide 16 is shown in FIG. 1 in the closed position. In this closed position the upper portion 22 of the tool guide 16 is accommodated within the aperture 14 and the upper portion 22 of the tool guide's 16 outer surface and inner surface are flush with the outer and inner surfaces of the wall portion 13, i.e. the tool guide 16 does not encroach into the bore of the tubular body 12. The tool guide 16 is locked closed by the lower tool guide portion 20 being retained between the surface of the tubular body 12 and a first tubular sleeve 24, preventing the tool guide 16 from pivoting inwardly under its own weight.

The tubular body 12 also includes externally mounted bidirectional resilient seals 40, 42, 43, 48, 50, 58 and 59. Seal 42 is mounted above the aperture 14 and tool guide 16, and seal 58 is mounted below, these seals maintain the lubricator system's pressure integrity when exposed to well bore pressures.

Hydraulic pressure is used to move the first sleeve 24 from the position shown in FIG. 1 to its up/open position, revealing the aperture 14 (not shown, but discussed in more detail in the description of FIGS. 2*a*-2*e*). Hydraulic fluid 60 is contained in annular chamber 52, defined by the tubular body 12, the first sleeve 24, the seal 40 and seal 44; an internally mounted bidirectional resilient seal on the first sleeve 24. To move the first sleeve to the new position revealing the aperture 14 (not shown), hydraulic fluid is pumped in between seal 43 and seal 44 and displaced out of the annular chamber 52 by a hydraulic pump system (not shown). The pressure of the hydraulic fluid between seals 43 and 44 causes the first sleeve 24 to move upwards. This is explained in more detail in the description of FIGS. 2*a*-2*e*.

The lubricator system 10 also includes an array of pivotable latches 26, of which 2 are shown, and a second tubular sleeve 28. The pivotable latches 26 are mounted on pivots 25, connecting the latches 26 to the tubular body 12, and have grooved inner surfaces 27. Each latch 26 is mounted such that a line of action due to its own weight does not pass through the pivot 25 but creates a torque about the pivot 25 to cause latch 26 to fall outwardly when unrestrained, as will be later described. The grooved surfaces 27 of the latches 26 engage with complementary grooved surfaces 29 on the lower end of the first sleeve 24 and, when engaged, the latches 26 lock the first sleeve 24 in the position shown in FIG. 1. The latches 26 are held in the engaged position by the second sleeve 28. The second sleeve 28 is also axially moveable by hydraulic pressure from the position shown in FIG. 1 to a second position, axially displaced from the latches 26 (not shown).

In FIG. 1 the annular chamber 54, defined by the tubular body 12, the second sleeve 28, seal 48, and bidirectional resilient seal 46, mounted on the internal surface of second sleeve 26, is filled with hydraulic fluid 61. The pressure created by the hydraulic fluid is sufficient to prevent the second sleeve 28 moving to the second position, axially displaced from the latches 26 (not shown). To move the second sleeve 28 to the second position, hydraulic fluid is pumped in between seals 50 and 46, and hydraulic fluid 61 is pumped out of the annular chamber 54, by a hydraulic pump system (not shown). The movement of the second sleeve will be described with reference to FIGS. 2*a*-2*e*.

The lubricator system 10 further includes integral test ports 102 and 104. When the system is as shown in FIG. 1, these ports 102 and 104 are used to check the seals 42, 43, 58 and 59 will withstand the pressures to which they will be exposed. Hydraulic pressure is applied to the test ports 102 and 104 via connection point 100.

Referring now to FIGS. 2*a* to 2*e*, there is shown longitudinal sectional views of the system of FIG. 1 drawn to a smaller scale and showing the sequence of operations performed when a tool is being removed from the lubricator.

Figure 2E:
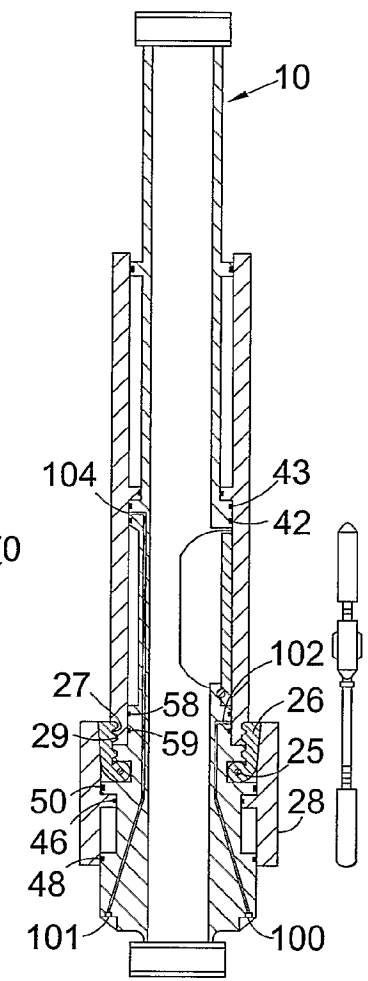
FIGS. 2*a* to 2*e* are longitudinal sectional views of the system of FIG. 1 drawn to a smaller scale and showing the sequence of operations performed when a tool is being removed from the lubricator.
Figure 2D:
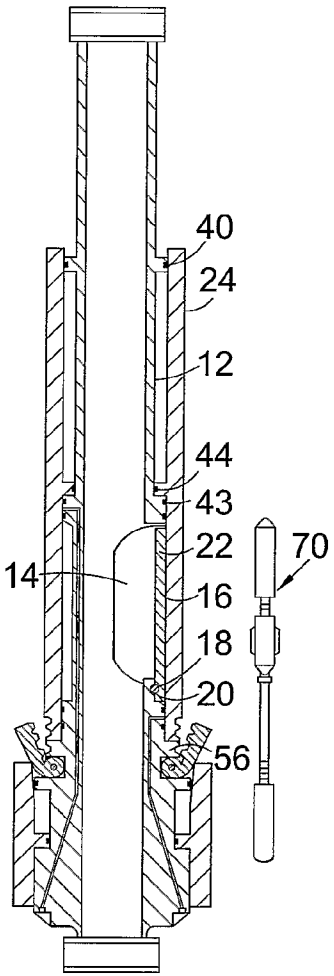
Figure 2C:
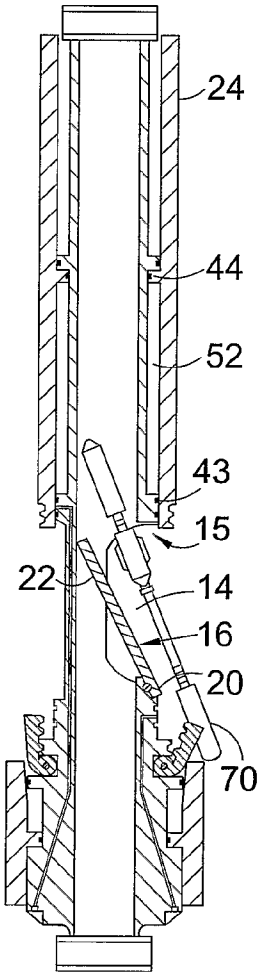
Figure 2B:
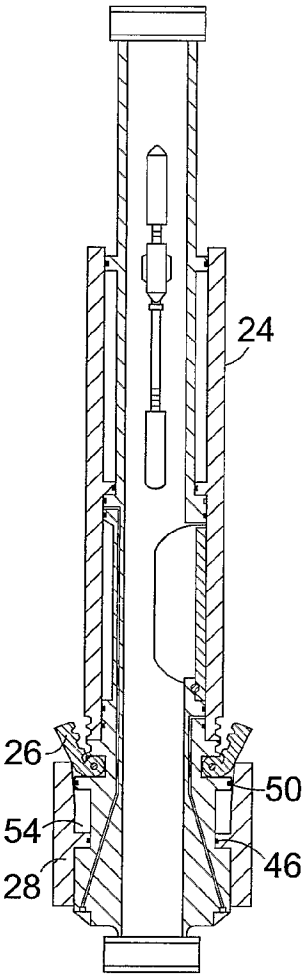
Figure 2A:
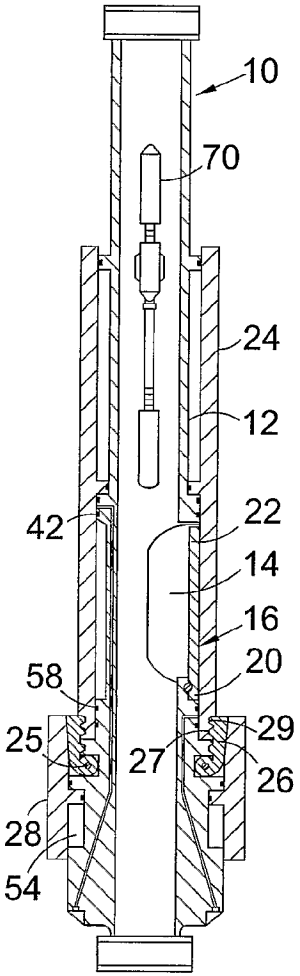

FIG. 2*a* shows the lubricator system 10 of FIG. 1 and a tool 70 to be removed from the lubricator system 10. The system 10 is shown in operational state as per FIG. 1 with the upper portion 22 of the tool guide 16 accommodated within the aperture 14 because the lower portion 20 of the tool guide 16 is confined between the tubular member 12 and the first sleeve 24. The first sleeve 24 is secured in position by the grooved surfaces 27 of latches 26 engaging with the complementary grooved surfaces 29 on the lower end of the first sleeve 24. The latches 26 are restrained in this position by second sleeve 28 in the position shown. The engagement of the internal bore of the first sleeve 24 with the bidirectional resilient seals 58, 42 provides the sealing integrity between the well bore and the external environment. The second sleeve 28 is secured in position by hydraulic pressure, created by the hydraulic fluid (not shown) in the annular chamber 54.

In FIG. 2*b* the second sleeve 28 has been displaced axially downwards from the latches 26 by releasing the hydraulic fluid (not shown) from annular chamber 54 (shown in FIG. 2*a*) and pumping hydraulic fluid in between seals 46 and 50 using a hydraulic pump system (not shown). The pressure built up between seals 46 and 50 displaces the second sleeve 28 to the position shown. With the second sleeve 28 displaced axially away from the pivotable latches 26, the line of action due to gravity passes outside the pivots and causes the latches 26 to pivot outwards under their own weight about pivots 25, and disengage from the lower end of first sleeve 24.

With the first sleeve 24 no longer restrained by the latches 26, the first sleeve 24 is displaced upwardly to reveal the aperture 14 and tool guide 16. In FIG. 2*c* the first sleeve 24 has been displaced upwards by removing the hydraulic fluid (not shown) from annular chamber 52 (shown in FIG. 2*b*) and pumping hydraulic fluid in between seals 43 and 44 using a hydraulic pump system (not shown). The pressure built up between seals 43 and 44 displaces the first sleeve 24 to the position shown in FIG. 2*c*. The first sleeve 24 will remain in this position as long as the hydraulic pressure is maintained between seals 43 and 44.

With the first sleeve 24 in this position, the lower portion 20 of the off-centre tool guide 16 is no longer restrained by the first sleeve 24 and the tubular body 12 and the upper portion 22 of the tool guide 16 pivots inwardly into the interior of the tubular body 12 under its own weight. A tool entry aperture 15 is now defined by the tool guide 16 and the aperture 14. The tool 70 is shown being removed from the tubular body 12. As the tool 70 descends, it engages with the tool guide 16 and is guided out through the tool entry aperture 15.

With the tool 70 fully removed, as shown in FIG. 2*d*, the lubricator system can be returned to its operational state. FIG. 2*d* further shows the first sleeve 24 returned to the position it occupied in FIG. 2*b*. The displacement from the position in FIG. 2*c* was achieved by removing the hydraulic fluid that had been pumped between seals 43 and 44 and pumping hydraulic fluid (not shown) between seals 40 and 44 to force the first sleeve 24 to move downwards. As the first sleeve 24 travels downwards, it engages with the lower portion 20 of the tool guide 16 causing the tool guide 16 to pivot outwardly about pivot 18. The first sleeve comes to rest against annular land 56. In this position the upper portion 22 of the tool guide 16 is fully accommodated within the aperture 14 and the upper portion 22 of the tool guide 16 is prevented from pivoting inward under its own weight by the lower portion 20 of the tool guide 16 being retained by the first sleeve 24 and the tubular member 12.

The final operation of the sequence, FIG. 2*e*, shows the lubricator system in its operational condition. The second sleeve 28 has been displaced back to the position it occupied in FIG. 2*a* by removing the hydraulic fluid that had been pumped between seals 46 and 50, and pumping hydraulic fluid between seals 46 and 48 to force the second sleeve 28 to move upwards. As the second sleeve 28 travels upwards, it engages the outward surfaces of the pivot able latches 26 causing the latches 26 to pivot inwards about pivots 25. The grooved surfaces 27 of the latches 26 engage with the complementary grooved surfaces 29 on the lower end of the first sleeve 24. When the shoulder of seal 46 on the second sleeve 28 comes to rest against the shoulder of seal 50 on the tubular body 12, the latches 26 are fully engaged with the lower end of the first sleeve 24 and the lubricator system 10 is ready to be pressure tested.

The system 10 is pressure tested by connecting a hydraulic pump (not shown) to connection points 100 and 101. These connection points are connected to integral test ports 104 and 102 respectively. Test port 104 enables pressure to be applied between seals 42 and 43 and test port 102 enables pressure to be applied between seals 58 and 59. Using the hydraulic pump, pressure can be applied to seals 42, 43, 58 and 59 to ensure they will withstand operating pressures.

Various modifications and improvements may be made to the embodiments hereinbefore described without departing from the scope of the invention.

Those of skill in the art will also recognise that the above described embodiments of the invention provide a lubricator section 10 that will provide access to the bore of the lubricator section 10, and a method of inserting or removing a tool into or out of a lubricator section through the entry aperture 15 defined by the upper portion 22 of the tool guide 16 and the aperture 14. Thus tools can be removed or inserted in a more efficient, and hence cost effective, manner than presently. In addition the system 10 removes the need for operators to work at high levels, decreasing the risk of accident or injury to the operators. The use of integral test ports 102 and 104, to test the integrity of the system, rather than the conventional solution of using drilling fluids, will also reduce the possibility of hydrate formation on the lubricator section 10.

The invention claimed is:

1. A lubricator system, the lubricator system including:

a tubular body defining a tubular bore, and the tubular bore having a wall portion defining an aperture, a tool guide disposed in said aperture, first sleeve means surrounding the tubular body and being moveable between a first position where said aperture is covered by the first sleeve means and a second position where said aperture is uncovered whereby access is provided to said tubular bore via said aperture, seal means to allow the lubricator system to withstand operating pressures when the first sleeve is in the first position, locking means engageable with the first sleeve means, said locking means being moveable between a locking and unlocking position, and wherein when the at least one locking means is engaged with the first sleeve means, the at least one locking means is held in position by a second sleeve means, the second sleeve means surrounding the locking means, the second sleeve means being moveable between a first position, preventing the at least one locking means from disengaging from the first sleeve means, and a second position, allowing the at least one locking means to disengage from the first sleeve means.

2. A system as claimed in claim 1 wherein the at least one locking means is held in position by hydraulic or pneumatic pressure.

3. A system as claimed in claim 1 wherein the at least one locking means are pivotable latches.

4. A system as claimed in claim 1 wherein the at least one locking means is a screwed connection or an expandable or collapsible split lock ring.

5. A system as claimed in claim 1 wherein the tool guide is dimensioned to be accommodated within the aperture defined by the wall portion.

6. A system as claimed in claim 4 wherein the tool guide is manufactured as a single piece.

7. A system as claimed in claim 5 wherein the tool guide comprises a plurality of individual fingers.

8. A system as claimed in claim 6 wherein the tool guide is mounted on a pivot, the pivot being mounted on the wall portion of the tubular body, the tool guide being pivotable between a first position where the tool guide does not encroach into the tubular bore and a second position where, in use, a tool string being lowered down the tubular bore will engage with the tool guide and be guided out of the bore through the aperture.

9. A system as claimed in claim 8 wherein the tool guide pivots from the first position to the second position under the tool guide's own weight.

10. A system as claimed in claim 8 wherein the tool guide moves from the first position to the second position under the action of an applied force.

11. A system as claimed in claim 1 wherein when the aperture is covered by the first sleeve means, the first sleeve means is engaged with the tool guide and the tool guide does not encroach into the tubular bore, and when the aperture is not covered by the first sleeve means, the tool guide is not engaged with the first sleeve means and the tool guide moves to the second tool guide position.

12. A system as claimed in claim 11 wherein the first sleeve means is moved hydraulically between the first and second positions.

13. A system as claimed in claim 11 wherein the first sleeve means is moved under the action of either an electric motor or a pneumatic actuator.

14. A system as claimed in claim 11 wherein the second sleeve means is moved hydraulically between the first and second positions.

15. A system as claimed in claim 11 wherein the second sleeve means is moved under the action of an electric motor.

16. A system as claimed in claim 1 wherein the seal means are bi-directional resilient seals.

17. A system as claimed in claim 1 wherein the lubricator systems includes integral test ports to pressure test the system.

18. A method of inserting or removing a tool into or out of a lubricator section of a lubricator system, the method including the steps of:

displacing a first sleeve means to reveal a tubular body, said tubular body defining a tubular bore for receiving an intervention tool string, said tubular body defining an aperture, displacing a tool guide in said aperture in said tubular body to allow access to said bore for inserting or removing a tool, inserting or removing a tool into or out of the tubular bore through the aperture, replacing said tool guide, and replacing said first sleeve means, and wherein prior to said displacement of the first sleeve, displacing a second sleeve to allow an at least one locking means to disengage from the first sleeve.

19. A method as claimed in claim 18 wherein the method further includes, subsequent replacing the first sleeve means, the step of:

replacing the second sleeve thereby actuating the at least one locking means and engaging the at least one locking means with the first sleeve.

* * * * *